US011316282B2

(12) United States Patent
Chen et al.

(10) Patent No.: US 11,316,282 B2
(45) Date of Patent: Apr. 26, 2022

(54) ANTENNA UNIT AND ANTENNA ARRAY

(71) Applicant: AAC Technologies Pte. Ltd., Singapore (SG)

(72) Inventors: Yongli Chen, Shenzhen (CN); Jianan Wang, Shenzhen (CN); Xinying Xu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/996,900

(22) Filed: Aug. 19, 2020

(65) Prior Publication Data

US 2020/0412020 A1 Dec. 31, 2020

Related U.S. Application Data

(63) Continuation of application No. PCT/CN2019/093969, filed on Jun. 29, 2019.

(51) Int. Cl.

| | |
|---|---|
| ***H01Q 1/38*** | (2006.01) |
| ***H01Q 21/06*** | (2006.01) |
| ***H01Q 21/00*** | (2006.01) |
| ***H01Q 21/08*** | (2006.01) |

(52) U.S. Cl.

CPC ..... *H01Q 21/065* (2013.01); *H01Q 1/38* (2013.01); *H01Q 21/0006* (2013.01); *H01Q 21/08* (2013.01)

(58) Field of Classification Search

CPC .... H01Q 21/065; H01Q 1/38; H01Q 21/0006; H01Q 21/08; H01Q 9/0457; H01Q 9/0414; H01Q 9/0421; H01Q 1/48; H01Q 1/50; H01Q 9/0407; H01Q 5/20; H01Q 5/30

See application file for complete search history.

(56) References Cited

U.S. PATENT DOCUMENTS

| | | | | |
|---|---|---|---|---|
| 11,139,550 | B2 * | 10/2021 | Yang | H01Q 5/30 |
| 2004/0090367 | A1 * | 5/2004 | Montgomery | H01Q 1/38 343/700 MS |
| 2015/0333407 | A1 * | 11/2015 | Yamagajo | H01Q 5/40 343/905 |
| 2019/0267697 | A1 * | 8/2019 | Quinlan | H01Q 5/30 |
| 2019/0379134 | A1 * | 12/2019 | Paulotto | H01Q 3/28 |
| 2021/0313703 | A1 * | 10/2021 | Stanley | H01Q 21/0006 |

* cited by examiner

*Primary Examiner* — David E Lotter
(74) *Attorney, Agent, or Firm* — W&G Law Group

(57) ABSTRACT

The antenna unit includes a first radiation patch, a feed structure, a second radiation patch, a ground plate, and an insulating dielectric layer. The first radiation patch is electrically connected with the ground plate. The feed structure includes a feeding post and an outer ring. The feeding post passes through the insulating dielectric layer and the ground plate, and one end of the feeding post is connected with the second radiation patch, the other end of the feeding post extends out of the ground plate. The ground plate is provided with a first avoidance hole for avoiding the feeding post, and an outer wall surface of the outer ring is connected with an inner wall surface of the first avoidance hole. The feeding post is coaxial with the feeding outer ring and arranged separately from the feeding outer ring. A dual-frequency and a dual-polarization are formed in the present disclosure.

14 Claims, 7 Drawing Sheets

ANTENNA UNIT AND ANTENNA ARRAY

TECHNICAL FIELD

The present disclosure relates to antenna technology, in particular to an antenna unit and an antenna array.

BACKGROUND

At present, there are few researches on arrays that realize dual-frequency and dual-polarization in millimeter wave band. Dual-polarization in low frequency band is mostly realized by adopting an independent structure, while dual-frequency is mostly realized by adopting the form of slots and multilayer patches. However, there are few researches on arrays that realize dual-frequency and dual-polarization in millimeter wave band. The bandwidth covered by 28 GHZ and 39 GHZ is narrow, and the cross-polarization caused by dual-polarization is relatively poor, and there is a certain disadvantage in volume.

Therefore, it is necessary to provide an antenna unit that increases bandwidth and improves a cross-polarization ratio without increasing a volume.

SUMMARY

An objective of the present disclosure is to provide an antenna unit that increases bandwidth and improves a cross-polarization ratio without increasing a volume.

The technical solution of the present disclosure is as follows:

an antenna unit is provided, which includes a first radiation patch, a feed structure, a second radiation patch disposed separately from one side of the first radiation patch, a ground plate disposed separately from one side of the second radiation patch facing away from the first radiation patch, and an insulating dielectric layer disposed between the second radiation patch and the ground plate. The number of the feed structures is two. Each of the feed structures includes a feeding post and a feeding outer ring. The feeding post passes through the insulating dielectric layer and the ground plate, and one end of the feeding post is connected with the second radiation patch, the other end of the feeding post extends out of the ground plate. The ground plate is provided with a first avoidance hole for avoiding the feeding post, and an outer wall surface of the feeding outer ring is connected with an inner wall surface of the first avoidance hole. The feeding post is coaxial with the feeding outer ring and arranged separately from the feeding outer ring.

Further, the feeding post includes a first post and a second post with an outer diameter smaller than that of the first post. The first post penetrates and is provided within the insulating dielectric layer, and one end of the first post is connected with the second radiation patch. One end of the second post is connected with one end of the first post facing away from the second radiation patch, and the other end of the second post extends out of the ground plate.

Further, the antenna unit further includes a ground post. The ground post passes through the second radiation patch and the insulating dielectric layer, and one end of the ground post is connected with the first radiation patch and the other end of the ground post is connected with the ground plate. The second radiation patch is provided with a second avoidance hole for the ground post to pass through, and an outer wall of the ground post is not in contact with an inner wall of the second avoidance hole.

Further, a cross-sectional area of the first radiation patch is larger than a cross-sectional area of the second radiation patch.

Further, four feeding slots are disposed in the second radiation patch along a circumferential direction.

Further, the four feeding slots are distributed at equal intervals along a circumferential direction.

Further, each of the feeding slots includes a first opening and two second openings respectively communicated with both ends of the first opening. The second openings are arranged facing to an opposite side of the first opening of the feeding slot.

Further, a length direction of the second opening is perpendicular to a length direction of the first opening.

An antenna array is further provided, which is formed by connecting a plurality of the above-described antenna units.

The present disclosure has beneficial effects that a dual-frequency is formed by a double-layer patch coupling without increasing a volume of the antenna unit. In addition, an adjustment of the second radiation patch and the feed structure forms a good match, which has an obvious advantage in increasing a bandwidth and improving a cross-polarization ratio. Further, a dual-polarization implementation mode is simple in structure without requiring an extra power division and inverse structure support.

Figure 1:
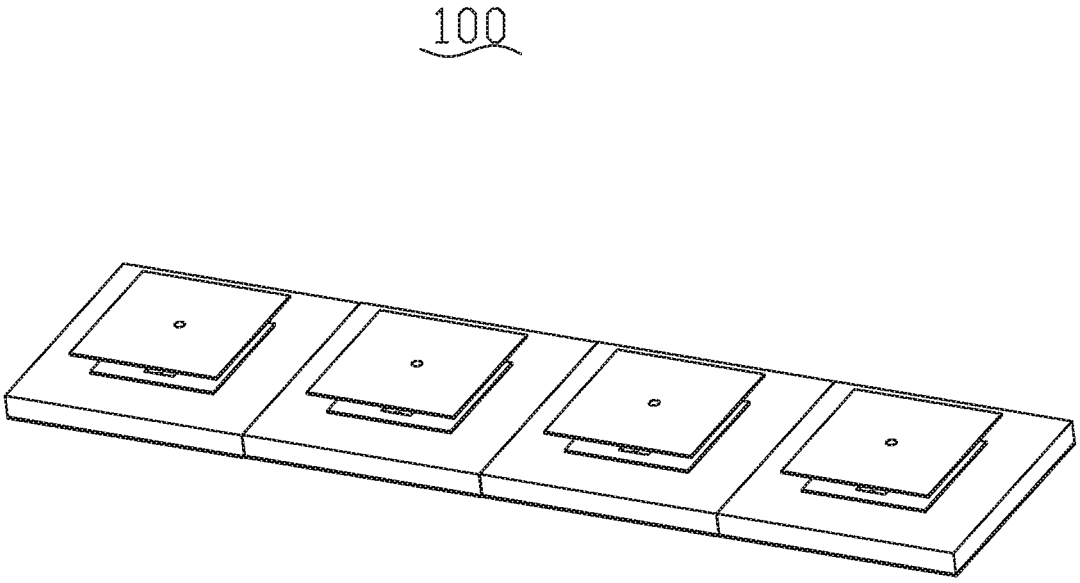
FIG. 1 is a schematic structural diagram of an antenna array in an embodiment of the present disclosure.
Figure 2:
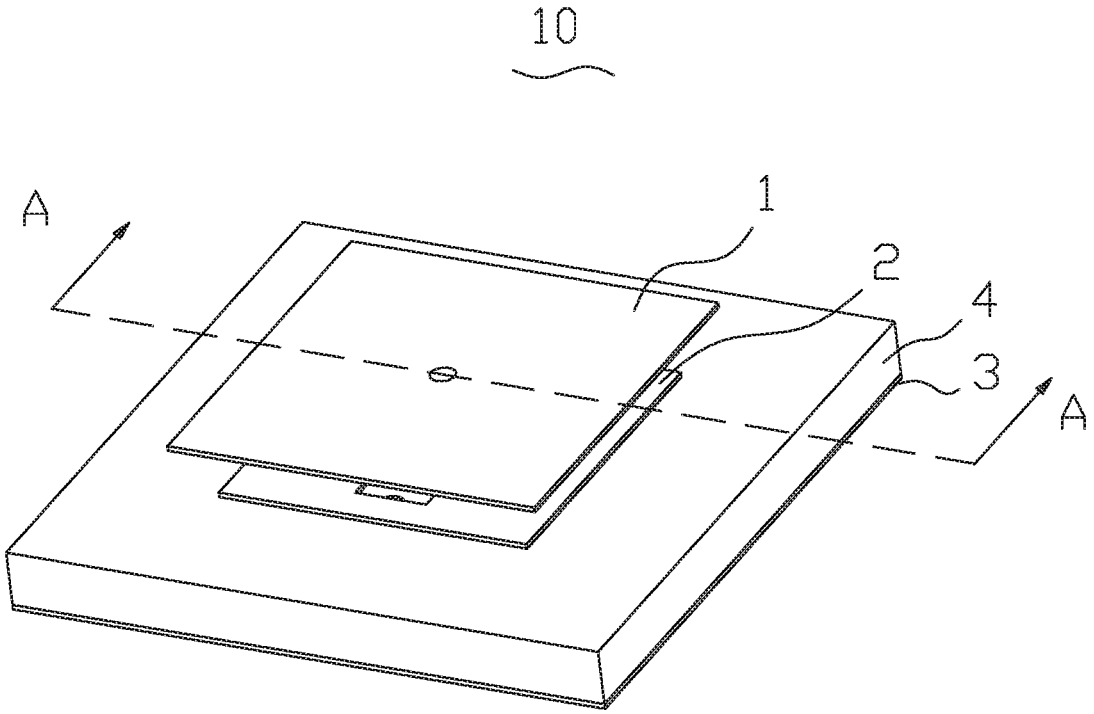
FIG. 2 is a schematic structural diagram of an antenna unit in an embodiment of the present disclosure.
Figure 3:
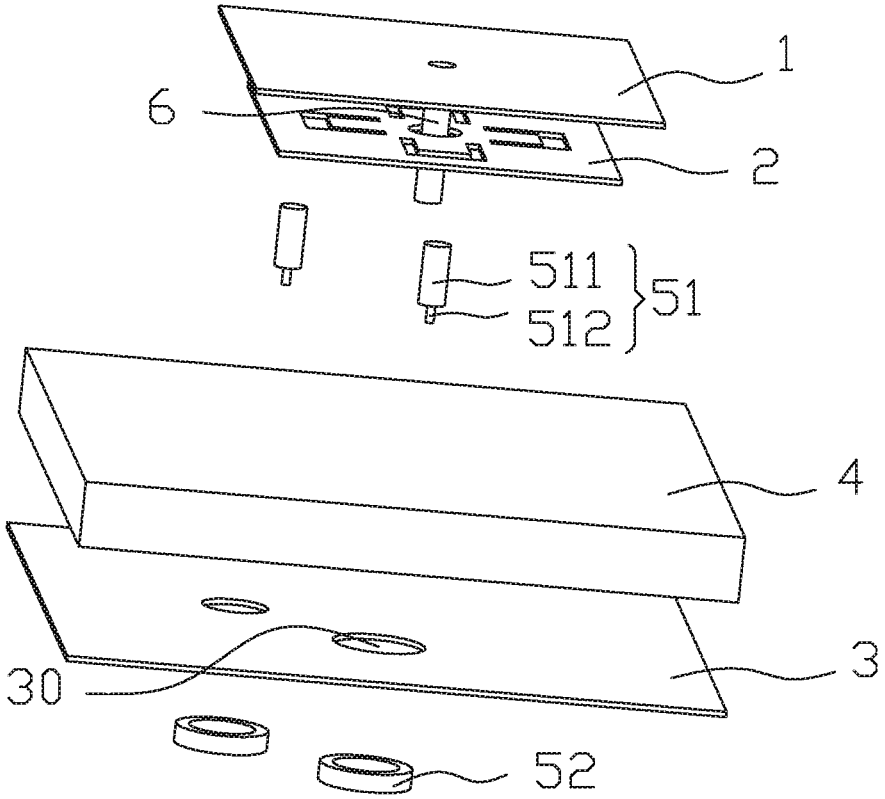
FIG. 3 is an exploded view of the antenna unit in FIG. 2.
Figure 4:
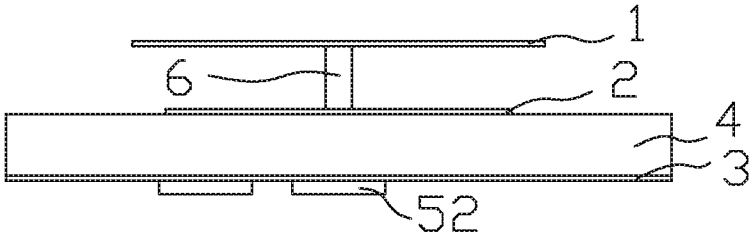
FIG. 4 is a front view of the antenna unit in FIG. 2.
Figure 5:
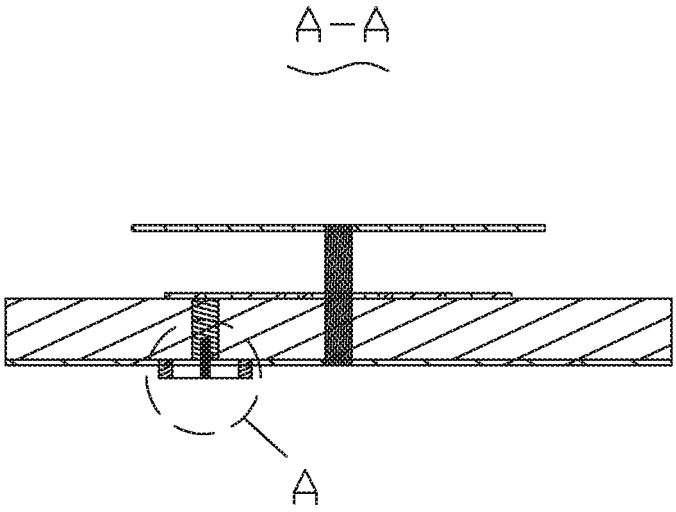
FIG. 5 is a sectional view of FIG. 2 along the line A-A.
Figure 6:
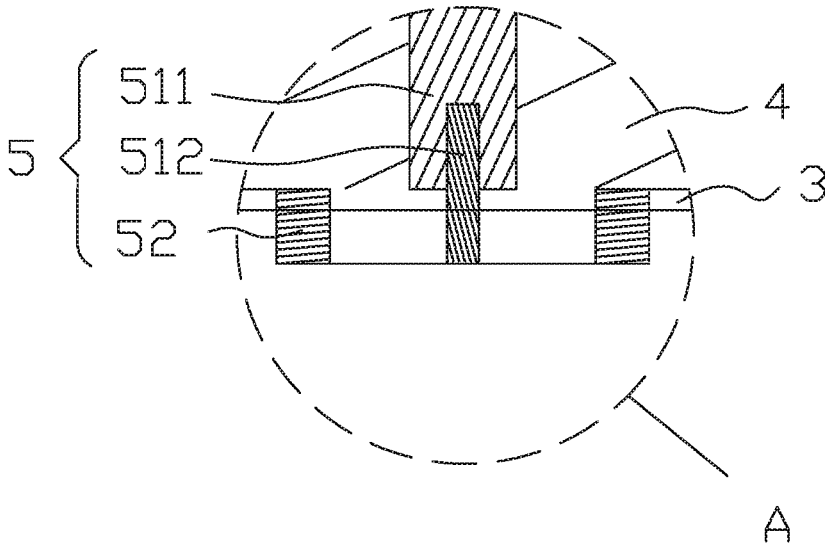
FIG. 6 is a partially enlarged view at A section in FIG. 5.
Figure 7:
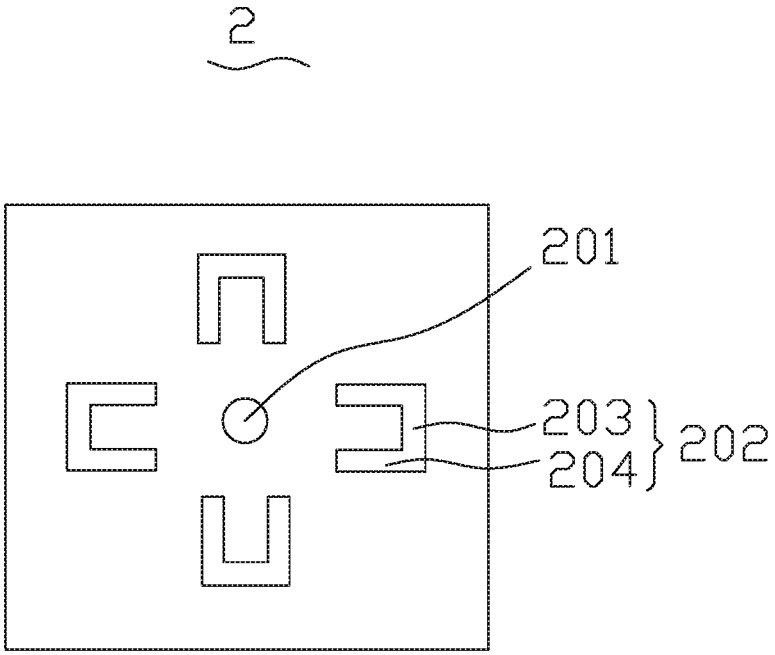
FIG. 7 is a schematic structural diagram of a second radiation patch of the antenna unit in an embodiment of the present disclosure.

100: Antenna array; 10: Antenna unit; 1: First radiation patch; 2: Second radiation patch; 3: Ground plate; 4: Insulating dielectric layer; 5: Feed structure; 51: Feeding post; 52: Protection ring; 30: First avoidance hole; 511: First post; 512: Second post; 201: Second avoidance hole; 6: Ground post; 202: Feeding slot; 203: First opening; 204: Second opening.

DETAILED DESCRIPTION

The present disclosure will be further described below with reference to accompanying drawings and embodiments.

Referring to FIGS. 2 to 6, an antenna unit 10 includes a first radiation patch 1, a feed structure 5, a second radiation patch 2 disposed separately from one side of the first radiation patch 1 and coupled with the first radiation patch 1, a ground plate 3 disposed separately from one side of the second radiation patch 2 facing away from the first radiation patch 1, and an insulating dielectric layer 4 disposed between the second radiation patch 2 and the ground plate 3. The first radiation patch 1 and the ground plate 3 are electrically connected. The number of the feed structures 5 is two. Each of the feed structures 5 includes a feeding post 51 and a feeding outer ring 52. The feeding post 51 passes through the insulating dielectric layer 4 and the ground plate 3, one end of the feeding post 51 is connected with the second radiation patch 2, and the other end of the feeding post extends out of the ground plate 3. The ground plate 3 is provided with a first avoiding hole 30 for avoiding the feeding post 51, and an outer wall surface of the feeding outer ring 52 is connected with an inner wall surface of the first avoidance hole 30. The feeding post 51 is coaxial with the feeding outer ring 52 and arranged separately from the feeding outer ring.

A dual-frequency is formed by a double-layer patch coupling without increasing a volume of the antenna unit. A dual polarization is realized by adjusting the second radiation patch 2 and the two feed structures 5, which has an obvious advantage in increasing a bandwidth and improving a cross-polarization ratio. In addition, the implementation mode is simple in structure without requiring an extra power division and inverse structure support. A dielectric constant of the insulating dielectric layer is preferably 3.3, and a matching may be effectively adjusted by positions and sizes of the two feed structures.

Preferably, the feeding post 51 includes a first post 511 and a second post 512 with an outer diameter smaller than that of the first post 511. The first post 511 penetrates and is provided within the insulating dielectric layer 4, and one end of the first post 511 is connected with the second radiation patch 2. One end of the second post 512 is connected with one end of the first post 511 facing away from the second radiation patch 2, and the other end of the second post 512 extends out of the ground plate 3.

An end surface of the first post 511 facing away from the second radiation patch 2 is flush with an end surface of the insulating dielectric layer 4 facing away from the second radiation patch 2. One end of the second post 512 is embedded in the first post 511, and an end surface of the second post 512 facing away from the first post 511 is flush with an end surface of the feeding outer ring 52 facing away from the second radiation patch 2.

Preferably, the antenna unit 10 further includes a ground post 6. The ground post 6 passes through the second radiation patch 2 and the insulating dielectric layer 4, and one end of the ground post 4 is connected with the first radiation patch 1 and the other end of the ground post 4 is connected with the ground plate 3. The second radiation patch 2 is provided with a second avoidance hole 201 for the ground post 6 to pass through, and an outer wall of the ground post 4 is not in contact with an inner wall of the second avoidance hole 201.

The ground post 4 plays a role in supporting the first radiation patch 1, and the second radiation patch 2 is supported on the insulating dielectric layer 4.

Preferably, a cross-sectional area of the first radiation sheet 1 is larger than a cross-sectional area of the second radiation patch 2.

Preferably, four feeding slots 202 are disposed in the second radiation patch 2 along a circumferential direction. The four feeding slots 202 are disposed in the second radiation patch 2 along a circumferential direction to enhance the dual-frequency effect.

Preferably, the four feeding slots 202 are distributed at equal intervals along a circumferential direction. The four feeding slots 202 have the same shape.

Preferably, each of the feeding slots 202 includes a first opening 203 and two second openings 204 respectively communicated with both ends of the first opening 203. The second openings 204 are arranged facing to an opposite side of the first opening of the feeding slot.

Preferably, a length direction of the second opening 204 is perpendicular to a length direction of the first opening 203.

Referring to FIG. 1, the present disclosure further provides an antenna array 100 formed by connecting a plurality of the above-described antenna units 10.

The above description is merely embodiments of the present disclosure. It should be pointed out that, those of ordinary skills in the art may make improvements without departing from the inventive concept of the present disclosure, such improvements, however, fall within the protection scope of the present disclosure.

What is claimed is:

1. An antenna unit, comprising a first radiation patch, a feed structure, a second radiation patch disposed separately from one side of the first radiation patch, a ground plate disposed separately from one side of the second radiation patch facing away from the first radiation patch, and an insulating dielectric layer disposed between the second radiation patch and the ground plate, wherein the first radiation patch is electrically connected with the ground plate, the number of the feed structures is two, and each of the feed structures comprises a feeding post and a feeding outer ring, wherein the feeding post passes through the insulating dielectric layer and the ground plate, one end of the feeding post is connected with the second radiation patch, and the other end of the feeding post extends out of the ground plate, wherein the ground plate is provided with a first avoidance hole for avoiding the feeding post, an outer wall surface of the feeding outer ring is connected with an inner wall surface of the first avoidance hole, and the feeding post is coaxial with the feeding outer ring and arranged separately from the feeding outer ring;

the feeding post comprises a first post and a second post with an outer diameter smaller than that of the first post, the first post penetrates and is provided within the insulating dielectric layer and one end of the first post is connected with the second radiation patch, one end of the second post is connected with one end of the first post facing away from the second radiation patch, and the other end of the second post extends out of the ground plate.

2. The antenna unit according to claim 1, wherein the antenna unit further comprises a ground post, the ground post passes through the second radiation patch and the insulating dielectric layer, and one end of the ground post is connected with the first radiation patch and the other end of the ground post is connected with the ground plate, the second radiation patch is provided with a second avoidance hole for the ground post to pass through, and an outer wall of the ground post is not in contact with an inner wall of the second avoidance hole.

3. The antenna unit according to claim 1, wherein a cross-sectional area of the first radiation patch is larger than a cross-sectional area of the second radiation patch.

4. The antenna unit according to claim 1, wherein four feeding slots are disposed in the second radiation patch along a circumferential direction.

5. The antenna unit according to claim 4, wherein the four feeding slots are distributed at equal intervals along a circumferential direction.

6. The antenna unit according to claim 5, wherein each of the feeding slots comprises a first opening and two second openings respectively communicated with both ends of the first opening, and the second openings are arranged facing to an opposite side of the first opening of the feeding slot.

7. The antenna unit according to claim 6, wherein a length direction of the second opening is perpendicular to a length direction of the first opening.

8. An antenna array, formed by connecting a plurality of antenna units, wherein the antenna unit comprises a first radiation patch, a feed structure, a second radiation patch disposed separately from one side of the first radiation patch, a ground plate disposed separately from one side of the second radiation patch facing away from the first radiation patch, and an insulating dielectric layer disposed between the second radiation patch and the ground plate, wherein the first radiation patch is electrically connected with the ground plate, the number of the feed structures is two, and each of the feed structures comprises a feeding post and a feeding outer ring, wherein the feeding post passes through the insulating dielectric layer and the ground plate, one end of the feeding post is connected with the second radiation patch, and the other end of the feeding post extends out of the ground plate, wherein the ground plate is provided with a first avoidance hole for avoiding the feeding post, an outer wall surface of the feeding outer ring is connected with an inner wall surface of the first avoidance hole, and the feeding post is coaxial with the feeding outer ring and arranged separately from the feeding outer ring;

the feeding post comprises a first post and a second post with an outer diameter smaller than that of the first post, the first post penetrates and is provided within the insulating dielectric layer and one end of the first post is connected with the second radiation patch, one end of the second post is connected with one end of the first post facing away from the second radiation patch, and the other end of the second post extends out of the ground plate.

9. The antenna array according to claim 8, wherein the antenna unit further comprises a ground post, the ground post passes through the second radiation patch and the insulating dielectric layer, and one end of the ground post is connected with the first radiation patch and the other end of the ground post is connected with the ground plate, the second radiation patch is provided with a second avoidance hole for the ground post to pass through, and an outer wall of the ground post is not in contact with an inner wall of the second avoidance hole.

10. The antenna array according to claim 8, wherein a cross-sectional area of the first radiation patch is larger than a cross-sectional area of the second radiation patch.

11. The antenna array according to claim 8, wherein four feeding slots are disposed in the second radiation patch along a circumferential direction.

12. The antenna array according to claim 11, wherein the four feeding slots are distributed at equal intervals along a circumferential direction.

13. The antenna array according to claim 12, wherein each of the feeding slots comprises a first opening and two second openings respectively communicated with both ends of the first opening, and the second openings are arranged facing to an opposite side of the first opening of the feeding slot.

14. The antenna array according to claim 13, wherein a length direction of the second opening is perpendicular to a length direction of the first opening.

* * * * *